US006552668B1

(12) United States Patent
Berezovsky

(10) Patent No.: US 6,552,668 B1
(45) Date of Patent: Apr. 22, 2003

(54) ATTACHMENT TO TRAFFIC LIGHT APPARATUS FOR VISUAL INDICATION OF TRAFFIC LIGHT DURATION

(76) Inventor: Yefim Berezovsky, 1374 Cherrywood Sq., San Jose, CA (US) 95117

( * ) Notice: Subject to any disclaimer, the term of this patent is extended or adjusted under 35 U.S.C. 154(b) by 159 days.

(21) Appl. No.: 09/722,831

(22) Filed: Nov. 27, 2000

(51) Int. Cl.[7] ..... G08G 1/096

(52) U.S. Cl. ..... 340/929; 340/907; 340/908; 340/930

(58) Field of Search ..... 340/907, 908, 340/929, 930

(56) References Cited

U.S. PATENT DOCUMENTS 2,480,290 A * 8/1949 Fein ..... 340/929
2,588,739 A * 3/1952 Main ..... 340/929
2,842,627 A * 7/1958 Wagner ..... 340/929
3,408,623 A * 10/1968 Wagner ..... 340/929
4,255,737 A 3/1981 Casteel
4,590,455 A 5/1986 Fritzinger
5,726,648 A 3/1998 Soon
5,838,260 A * 11/1998 Liu ..... 340/929
6,087,962 A 7/2000 Rojas
6,310,562 B1 * 10/2001 Safronov et al. ..... 340/929

* cited by examiner

*Primary Examiner*—Daniel J. Wu

(57) ABSTRACT

An attachment to a traffic light apparatus for indicating duration of a current traffic light signal comprises a panel that consists of a plurality of lamps which are electrically connected in parallel to a source of power supply and are controlled by a clock signal from the traffic light apparatus via a central processing unit and a controller. Each lamp is connected to the power supply line via an individual relay, the contacts of which are opened and closed under control of commands from the aforementioned central processing unit via the controller. The indication panel is divided into a plurality of color cells. Each cell contains a lamp. On the oncoming traffic side each cell is closed with a transparent color plate that defines the color of the light with which the cell is illuminated when the lamp is lit. The color cells may have different arrangements such as an alternating order in each row or the same color of cells in each row with alternation of vertical or horizontal rows. When a green light signal is switched on, at the initial moments green lamps are lit in all the cells. With the laps of time, however, the green lamps are switched off in a stepwise manner, e.g., from the top to the bottom of the indication panel, so that a viewer sees a gradually decreased rectangular green image.

7 Claims, 9 Drawing Sheets

ATTACHMENT TO TRAFFIC LIGHT APPARATUS FOR VISUAL INDICATION OF TRAFFIC LIGHT DURATION

FIELD OF THE INVENTION

The present invention relates to traffic control devices, in particular, to an attachment to a traffic light apparatus for visual indication of traffic light duration.

BACKGROUND OF THE INVENTION

It has been known heretofore to incorporate into a traffic light various means for indicating the time left for illumination of a traffic light signal of one color before switching to a traffic light signal of another color.

For example, U.S. Pat. No. 4,255,737 issued in 1981 to R. Casteel teaches a traffic light apparatus, that has a four-sided housing, each side of which contains red and green areas that can be illuminated. Furthermore, each side contains a rotating semicircular mask which simultaneously and progressively covers one portion of one of the colored areas and uncovers a portion of the other colored area until the illumination of the traffic light is changed, thereby causing a change in traffic flow. The rotation of the masks together with the actuation of the various lights is controlled from a common ring gear disposed within the housing and driven by a single motor. A disadvantage of this device is that it incorporates the traffic light covering/uncovering means directly into the traffic light apparatus. In other words, for introducing such a device into practice, it would be required to replace all existing conventional traffic lights, which is not only expensive but may increase the occurrence of accidents because of confusion caused by new appearance of the traffic lights. Another disadvantage of the aforementioned traffic light apparatus is that it has a complicated mechanical construction with a plurality of interconnected moving parts. These parts operate synchronously and simultaneously in four opposite directions. Traffic light apparatuses of this type have to be suspended from a console or another type support above the center of the intersection. However, in a majority of cases, traffic lights of such type have been replaced by apparatuses installed on the corners of the street crossings and having signals facing only the oncoming traffic. Therefore the aforementioned device of U.S. Pat. No. 4,255,737 may find only an extremely limited practical application. Furthermore, this apparatus is not applicable to intersections, which require different traffic signals for vehicles going in mutually opposite directions, e.g., a red light in one direction and a left turn/green light for the vehicle going in the opposite direction. It would be very difficult to adjust and change the mode of operation in the above-described apparatus.

U.S. Pat. No. 4,590,455 issued in 1986 to G. Fritzinger teaches a traffic control system that has green and/or red signal lights blinked momentarily at a predetermined interval before the direction of traffic is changed. A marker is placed along the roadway at a normal distance of travel within the timing of the blink signal to enable motorists to gauge their driving to save gasoline and achieve greater safety solely by noting their location relative to the marker when the blink signal occurs. Further taught is the use of the traffic signaling system in connection with a semi-actuated controller that has a synchronizer providing a background cycle. The timing of the blink signal and the yellow caution signal is obtained from the synchronizer. A disadvantage of this device is that blinking of the green signal may cause confusion, whereas blinking of the red signal is already equivalent to a stop signal and may not be understood as an indicator of the approaching switch in the traffic direction. Furthermore, an addition of a marker on the road at the approach to the traffic light may distract the driver's attention.

U.S. Pat. No. 5,726,648 issued in 1998 to M. Soon describes a time indicating traffic light that includes a vertically-oriented and rectangular-parallelepiped-shaped housing, a circular-shaped "stop" indicator light, a circular-shaped "caution" indicator light, seven rectangular-shaped "go" indicator lights, and a time indicating display. The circular-shaped "stop" indicator light, the circular-shaped "caution" indicator light, and the seven rectangular-shaped "go" indicator lights are disposed in the vertically-oriented and rectangular-parallelepiped-shaped housing. The seven rectangular-shaped "go" indicator lights have a pair of parallel, elongated, spaced-apart, vertically-oriented, and rectangular-shaped "go" indicator lights, and five adjacent, slightly vertically spaced-apart, horizontally-oriented, and rectangular-shaped "go" lights. The five adjacent, slightly vertically spaced-apart, horizontally-oriented, and rectangular-shaped "go" lights extinguish progressively upwardly towards the circular-shaped "caution" indicator light at a predetermined rate determined by a timer while the pair of parallel, elongated, spaced-apart, vertically-oriented, and rectangular-shaped "go" indicator lights remain illuminated when at least one light of the five adjacent, slightly vertically spaced-apart, horizontally-oriented, and rectangular-shaped "go" lights is illuminated. The time indicating display is disposed on the vertically-oriented and rectangular-parallelepiped-shaped housing and provides a visible display of the time of illumination of the seven rectangular-shaped "go" indicator lights, so that an approaching vehicle can determine when the circular-shaped "caution" indicator light will be illuminated by dividing the time of illumination on the time indicating display by the number of lights of the five adjacent, slightly vertically spaced-apart, horizontally-oriented, and rectangular-shaped "go" lights extinguished and thereby prevent sudden acceleration followed by a sudden stop.

A disadvantage of this time-indicating traffic light consists in that it is based on an entirely new conception and would require replacement of all existing traffic light units. Another disadvantage is that the device has a rather complicated construction, and therefore is expensive to manufacture. A provision of several different rectangular-shaped "go" indicator lights would require an essential increase in the overall dimensions of the traffic light assembly, as it would be necessary to make each "go" indicator light and the digital indicator visible from a far distance. A driver may need time for obtaining, processing the information indicated by the complicated traffic light system, and for making a decision. All this has to be done immediately, which may not be feasible for an elderly people whose driving ability would be limited.

U.S. Pat. No. 6,087,962 issued in July 2000 to Hector R. Rojas describes an electric traffic light, with acoustic signs and with an indication of backward counting which includes lights prepared in three sectors with signaling screens that are controlled by a processor electrically linked to an optic and numeric counter. The circuit of optic formation is programmed in sequence and time to emit activation signals to certain sections of the lights to provide the brightness of the light on each screen. The circuit of the numeric formation is programmed to send signals of interruption of the power supply, simultaneously with the optic circuit, to certain sectors of the lights to provide visualization of numbers. Further, simultaneously with the optic and numeric circuit, a sound emitter emits a sound with each color.

A disadvantage of the device of U.S. Pat. No. 6,087,962 is that it has a complicated construction, requires modernization of all existing traffic lights, and that the numbers displayed on the color screens are not very legible from a distance and have dimensions limited by the diameters of the color screens, which are not very large.

The applicant of the present patent application has invented an attachment to a traffic light apparatus for visual indication of traffic light duration, which is disclosed in pending U.S. patent application Ser. No. 09/300,875 filed on Apr. 28, 1999 and for which a notice of allowance has been received.

The device of U.S. patent application Ser. No. 09/300,875 comprises an attachment to a conventional traffic light and is connected to its side wall for visually indicating the duration of the time remaining till switching of the current green, yellow, or red light in proportion to the dimension of the illuminated portion of the indicator. In accordance with one embodiment, the device is made in the form of a housing with a rotating drum, which is divided into three sections by nontransparent partitions, each containing an individual lamp. The cylindrical surface, which defines the periphery of each section of the drum, has a transparent portion in the form of a wedge. When the drum rotates, the lit sector is shown in the window of the device so that during rotation of the drum, the dimensions of the lit portion of the drum shown through the window decrease proportionally to the remaining part of the current traffic light signal. A disadvantage of the apparatus of this embodiment is a complicated construction, which contains rotating parts.

In accordance with another embodiment of the above application, the device for visual indication of traffic light duration consists of four panels arranged in a cross-like configuration with traffic lights placed into corner of each quadrants formed by the panels, so that a respective traffic light is seen from each direction of movement of vehicles. Each panel, in turn, consists of three sectors, each for respective color of the traffic light. Each sector is formed by several tubular fluorescent lamps connected in parallel to a source of electric power supply, so that under control of the CPU, controller, and relay, each sector indicates the time remaining to the moment of switching of the traffic light to another color by switching of fluorescent lamps in a stepwise manner. Only a sector, which is associated with the currently lit traffic light, operates one at a time, while the next sector is activated only with the activation of the next traffic light. Thus, in the device of the last-mentioned embodiment, the width of the warning panel is limited to the height of the traffic light apparatus, and only one of three sectors operates at a time. In other words, the overall dimensions of the warning sign device are limited and the entire warning indication panel is used inefficiently, as only about 30% of the panel surface is used at each moment of time. Thus, the lit cell cannot be seen well during rain, fog, or at other bad-weather conditions. Another disadvantage of the device under consideration is that its location is bound to the traffic light apparatus, as each panel is additionally is used as a shade for the traffic light.

OBJECTS OF THE INVENTION

It is an object of the invention to provide an attachment to traffic light apparatus for visual indication of traffic light duration, which is simple in construction, is free of moving parts, ensures sequential indication of traffic light duration signs of different colors over the entire length of the indication panel and therefore may have large dimensions, and can be installed in any convenient location, irrespective of the position of the traffic light apparatus.

SUMMARY OF THE INVENTION

An attachment to a traffic light apparatus for indicating duration of a current traffic light signal comprises a panel that consists of a plurality of lamps which are electrically connected in parallel to a source of power supply and are controlled by a clock signal from the traffic light apparatus via a central processing unit and a controller. Each lamp is connected to the power supply line via an individual relay, the contacts of which are opened and closed under control of commands from the aforementioned CPU via the controller. The indication panel is divided into a plurality of color cells. Each cell contains a lamp. On the oncoming traffic side each cell is closed with a transparent color plate that defines the color of the light with which the cell is illuminated when the lamp is lit. The color cells may have different arrangements such as an alternating order in each row or the same color of cells in each row with alternation of vertical or horizontal rows. When a green light signal is switched on, at the initial moment green lamps are lit in all the cells. With the laps of time, however, the green lamps are switched off in a stepwise manner, e.g., from the top to the bottom of the indication panel, so that a viewer sees a gradually decreased rectangular green image.

At the end of the green-light period, a narrow green strip, which corresponds to the size of the lowermost cell, is lit.

When the traffic light is switched from the green to yellow, the CPU switches the panel from the group of green lamps to the group of yellow lamps, and the process is repeated with the yellow lamps. Upon switching of the traffic light from the yellow to the red, the process is repeated for the group of red lamps. Thus, all three color warning signals, which indicate the time remaining to switching of the traffic light to the next color, are combined in one common indication panel. Other embodiments of the invention relate to the use of color tubular luminescent lamps.

DETAILED DESCRIPTION OF THE INVENTION

Figure 1:
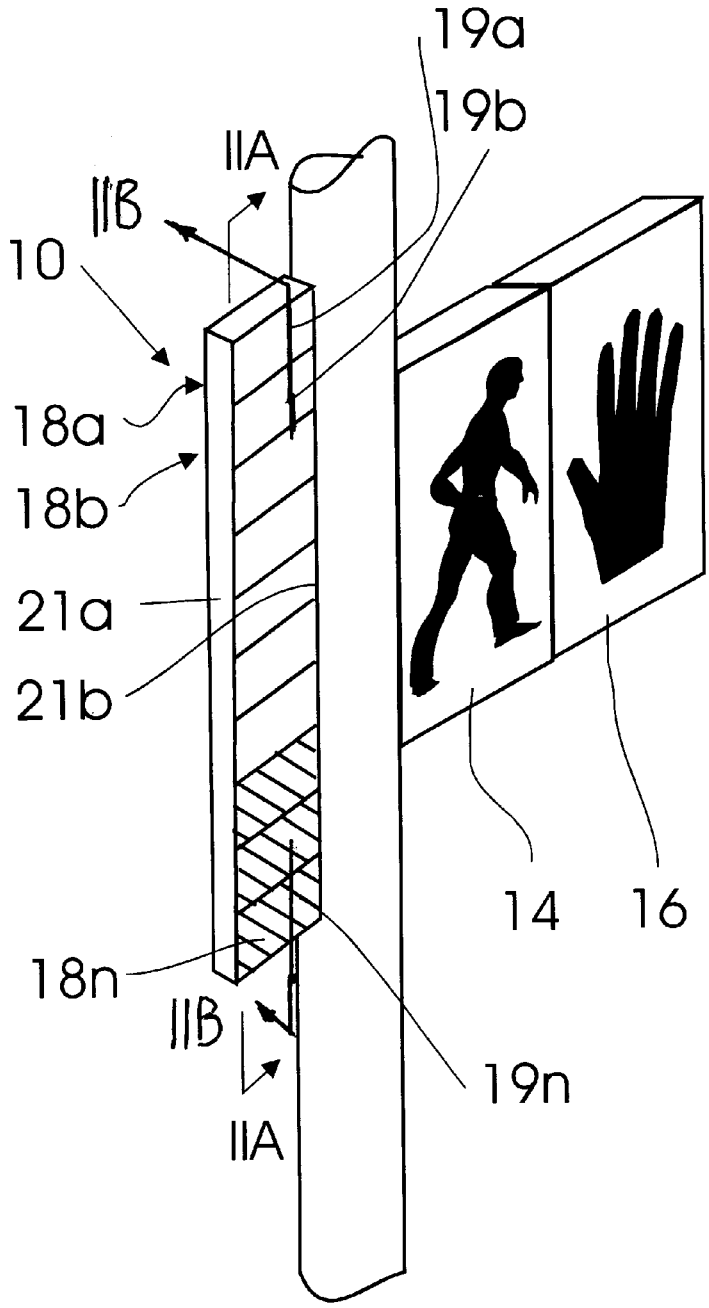
FIG. 1 is a general three-dimensional external view of the device of the invention.

FIGS. 1, 2, 3, 4—Embodiment with Tubular Horizontally Arranged Lamps A general three-dimensional external view of the device of the invention is shown in FIG. 1. The device 10, which constitutes an attachment to a traffic light apparatus (not shown) for visual indication of traffic light duration (hereinafter referred to simply as "device"), comprises a rectangular shaped vertically oriented panel that can be attached directly to the traffic light apparatus or to a pole 12 that supports conventional warning signal panels 14 and 16 for pedestrians, of the type shown in FIG. 1. Such a location is preferable in order a pedestrian can concentrate his/her attention on one area. The device 10 is assembled from a plurality of horizontally-arranged box-like cells 18*a*, 18*b*, . . . 18*n*. The housings 19*a*, 19*b*, . . . 19*n* of respective cells 18*a*, 18*b*, . . . 18*n* are made in the form of boxes of non-transparent material such as metal or plastic, which are closed from all sides, except for wide sides which face the oncoming traffics. These wide sides of the housings 19*a*, 19*b*, . . . 19*n* are closed from both sides of the housings by transparent plates 21*a*, 21*b* made of glass or plastic.

Figure 2A:
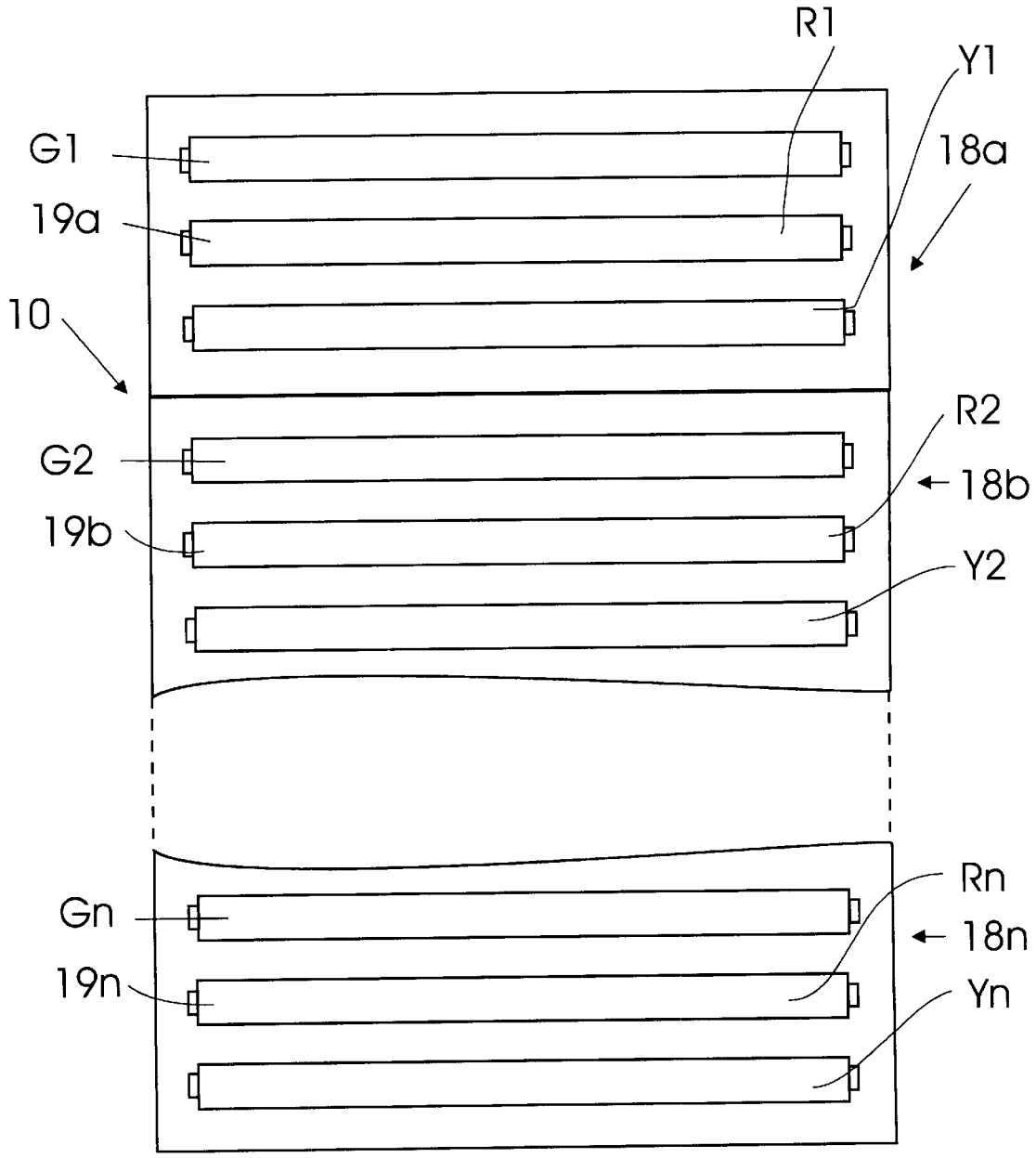
FIG. 2A is a cross-sectional view of the device of FIG. 1 along lines IIA—IIA for the embodiment with color lamps.

FIG. 2A is a cross-sectional view of the device 10 along lines IIA—IIA of FIG. 1. It can be seen from FIG. 2A that each cell 18*a*, 18*b*, . . . 18*n* contains three tubular gas-discharge lamps of three different colors, which a re arranged horizontally one above the other. Thus, as shown in FIG. 2A, the cell 18*a* contains lamps G1 (green lamp), R1 (red lamp), Y1 (yellow lamp); the cell 18*b* contains lamps G2 (green lamp), R2 (red lamp), Y2 (yellow lamp), . . . cell 18*n* contains lamps Gn (green lamp), Rn (red lamp), Yn (yellow lamp). In this embodiment, the term "lamps of different colors" means lamps with the lamp's bulb or cylindrical body made of color transparent glass. The lamps of different colors can be arranged in any order, but for uniformity of illumination of the entire panel, it is recommended that the arrangement of lamps of different colors be identical in all cells.

Figure 2B:
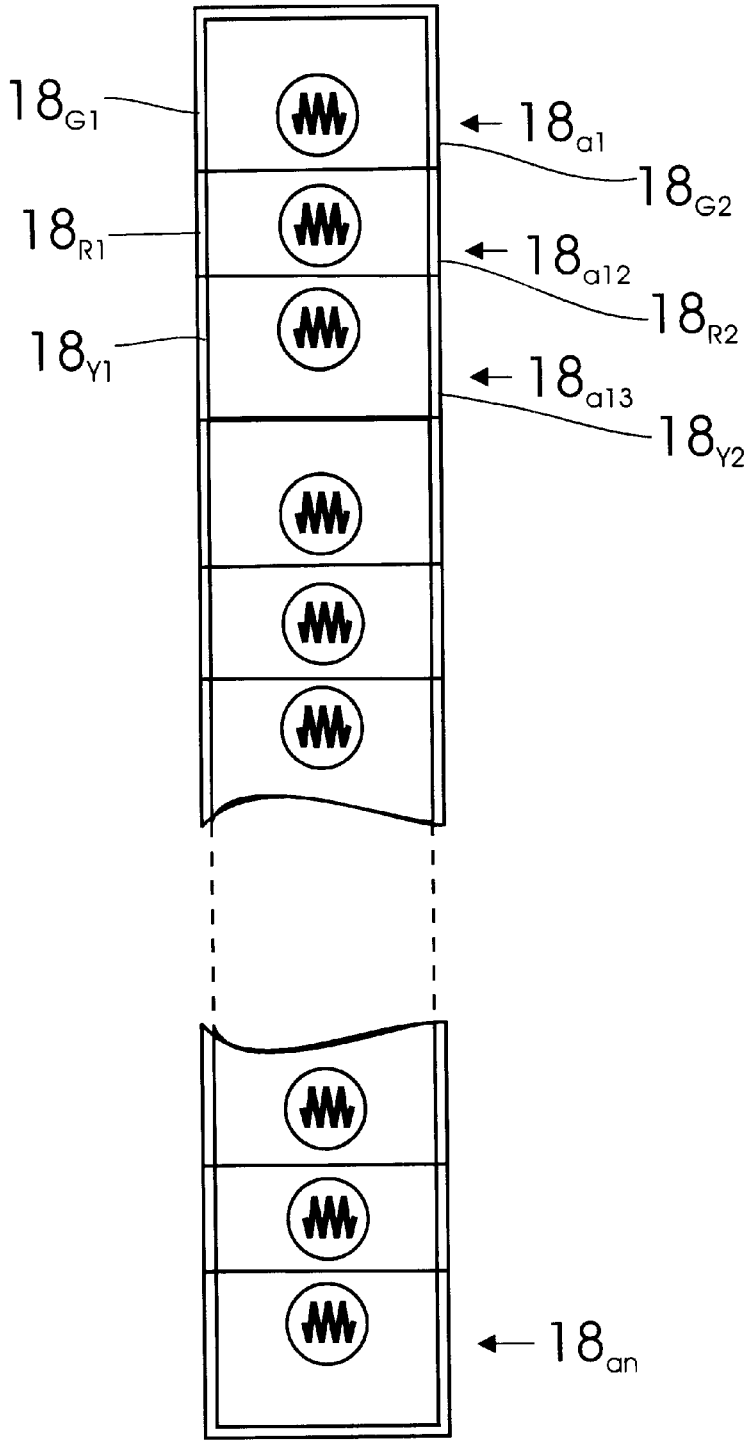
FIG. 2B is the same cross-sectional view as IIA—IIA for the embodiment with color transparent plates that close the cells with non-color lamps.

FIG. 2B is a cross-sectional view along the line IIB—IIB for the embodiment with color transparent plates that close the cells. In this embodiment, each cell 18*a*1, 18*a*2, 18*a*3, . . . 18*a*n contains a single non-color lamp. Each cell is closed from the sides that face the oncoming traffic with colored plates which are arranged in an alternating order. Thus, the cell 18*a*1 is covered with green plates 18G1 and 18G2, the cell 18*a*2 is closed with red plates 18R1 and 18R2, the cell 18*a*3 is closed with yellow plates 18Y1 and 18Y2, . . . , etc.

Figure 3:
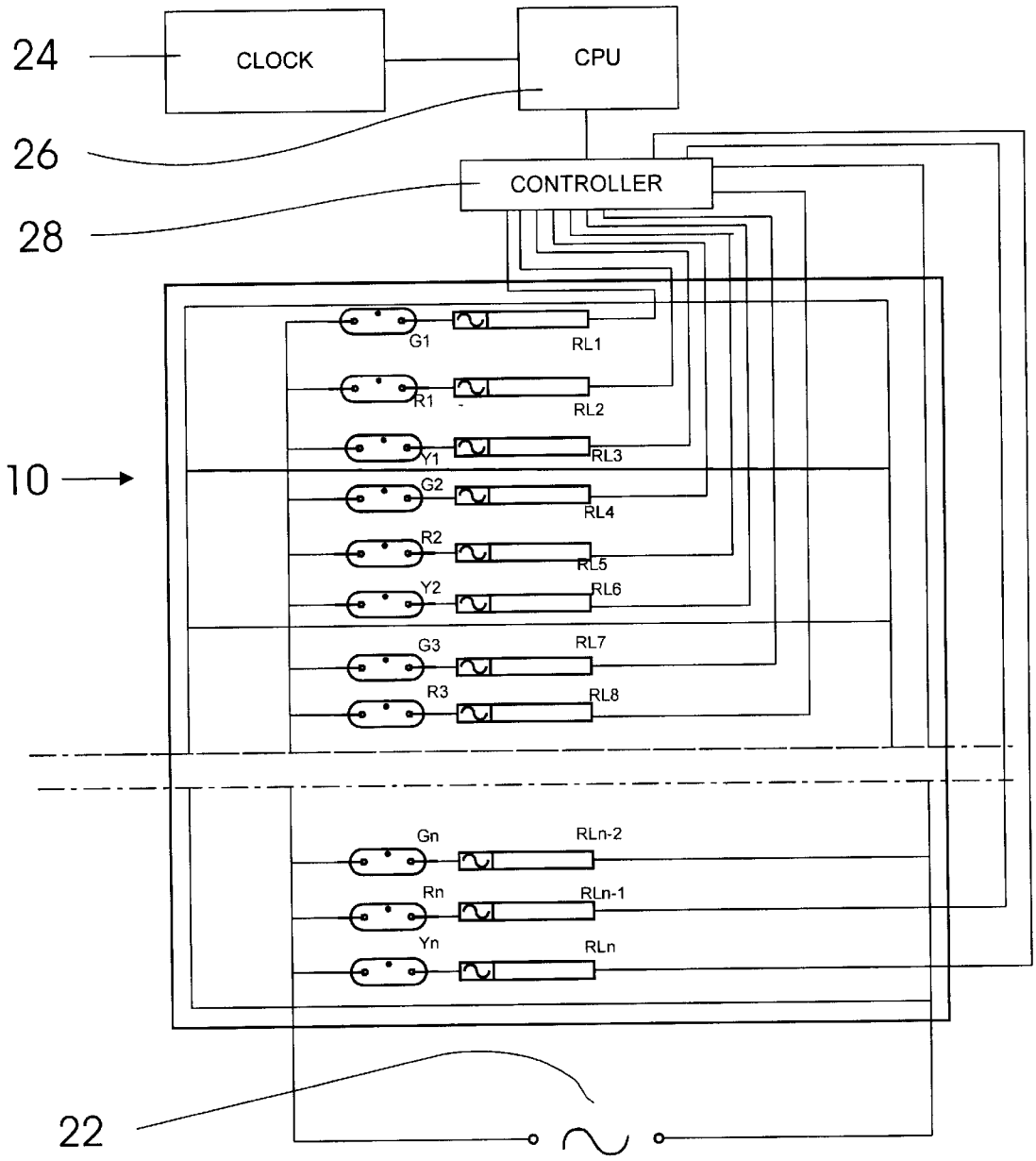
FIG. 3 is an electrical diagram of the device of the invention.

FIG. 3 is an electrical diagram of the device 10 according to the first embodiment of the invention. All lamps of different colors G1, R1, Y1, G2, R2, Y2, . . . Gn, Rn, Yn are connected in parallel to a power supply source 22. Connected in series to each lamp is a respective relay RL1 (in the circuit of lamp G1), RL2 (in the circuit of lamp R1), . . . RLn−2 (in the circuit of lamp Gn), RLn−1 (in the circuit of lamp Rn), and RLn (in the circuit of lamp Yn).

The sequence of switching of the lamps is controlled by clock pulses from clock circuit 24 in synchronism with the main traffic light apparatus (not shown). The clock circuit is connected to a central processing unit 26 which controls, via a controller 28, opening and closing of contacts in relays RL1, RL2, . . . RLn.

Figure 4:
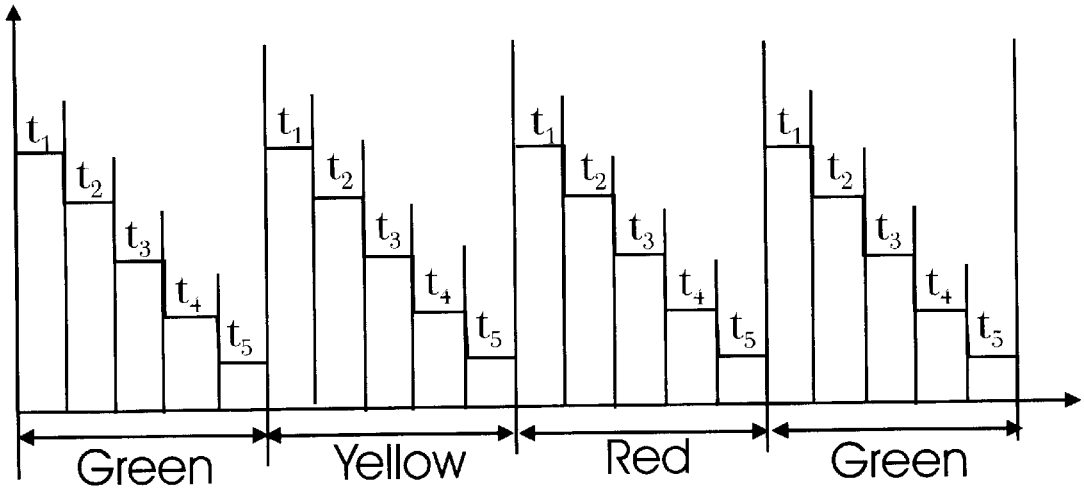
FIG. 4 is a graph in which the hatched areas show illuminated surfaces of the indication panel of the device at different periods of time.

In operation, the clock signals are sent from the clock circuit 24 to the CPU 26, which sends an output signals via the controller 28 to respective relays RL1, RL3, RL7, . . . RLn−2 in the circuits of lamps of the same color, in this case of lamps G1, G2, . . . Gn. The signals are sent to the aforementioned relays via lines L1, L2, . . . Ln. When the traffic light is switched from the red to green light, the CPU 26 controls operation of the green lamps G1, G2, . . . Gn so that at the initial period of time t1 all green lamps are lit simultaneously. This condition is shown in FIG. 4 in which the hatched areas show illuminated surfaces (lit area) of the indication panel of the device 10 at different periods of time. After the time t1 has lapsed, the CPU switches the lamp G1 off, while the remaining green lamps G2, . . . Gn remain illuminated till the moment t2, at which the second green lamp G2 is switched off, and so on. The panel remains lit green till the moment t5, when the traffic light (not shown) is switched off from green to yellow. At this moment the CPU 26 sends a command to all yellow lamps Y1, Y2, . . . Yn which at the initial period of time t5 to t6 are lit altogether. At the moment t6 the first yellow lamp Y1 is switched off, while remaining yellow lamps remain illuminated, and so on, till the moment when the yellow traffic light is switched off and the red traffic light is switched on. The process is then repeated for the illumination of the red lamps R1, R2, . . . Rn, till the green lamps G1, G2, . . . Gn are switched on again.

Figure 5:
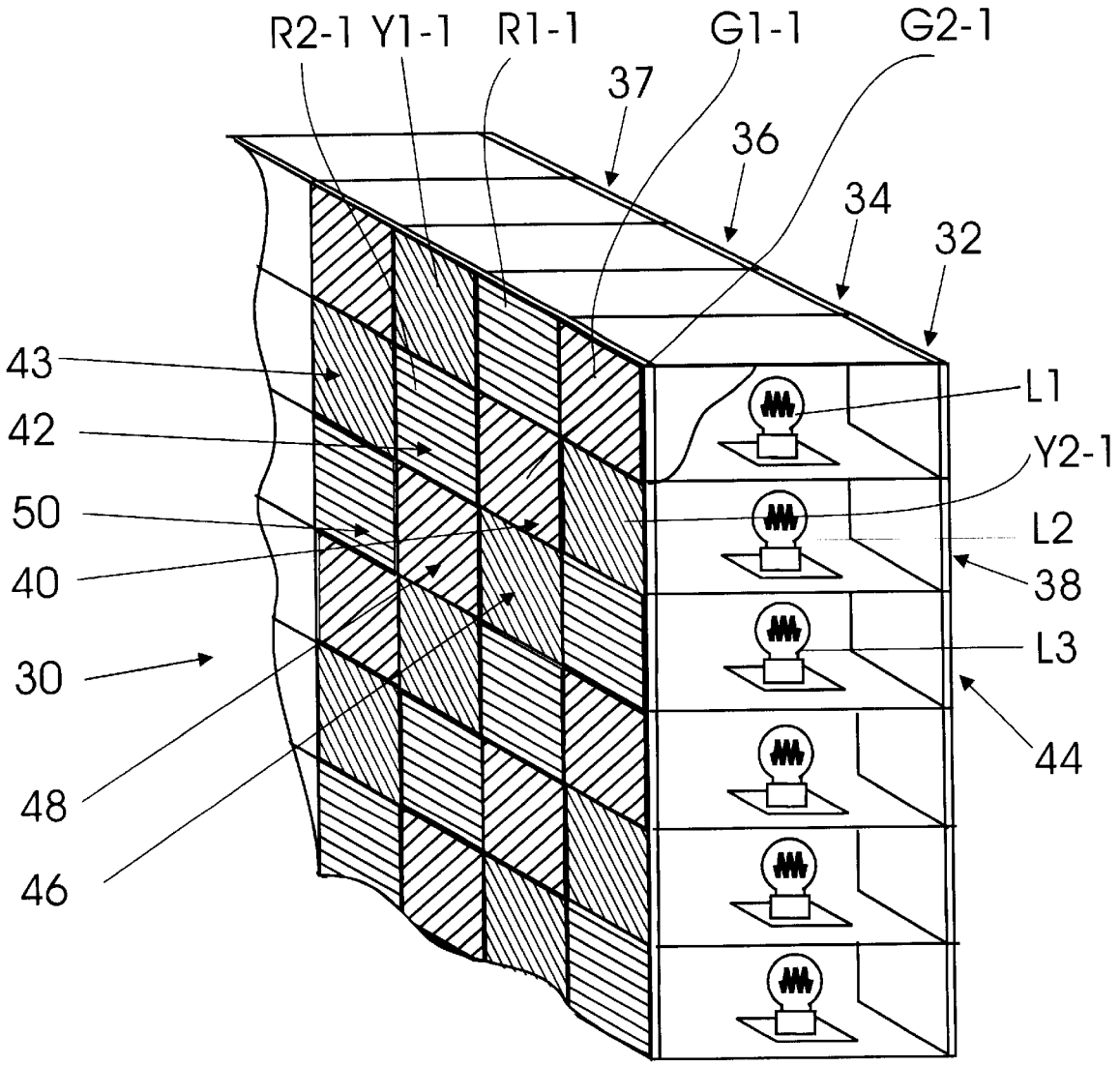
FIG. 5 is a fragmental three-dimensional view of the device of the invention, which consists of a plurality of color cells organized into a matrix form with alternating order of cells of different color in each row.
Figure 6:
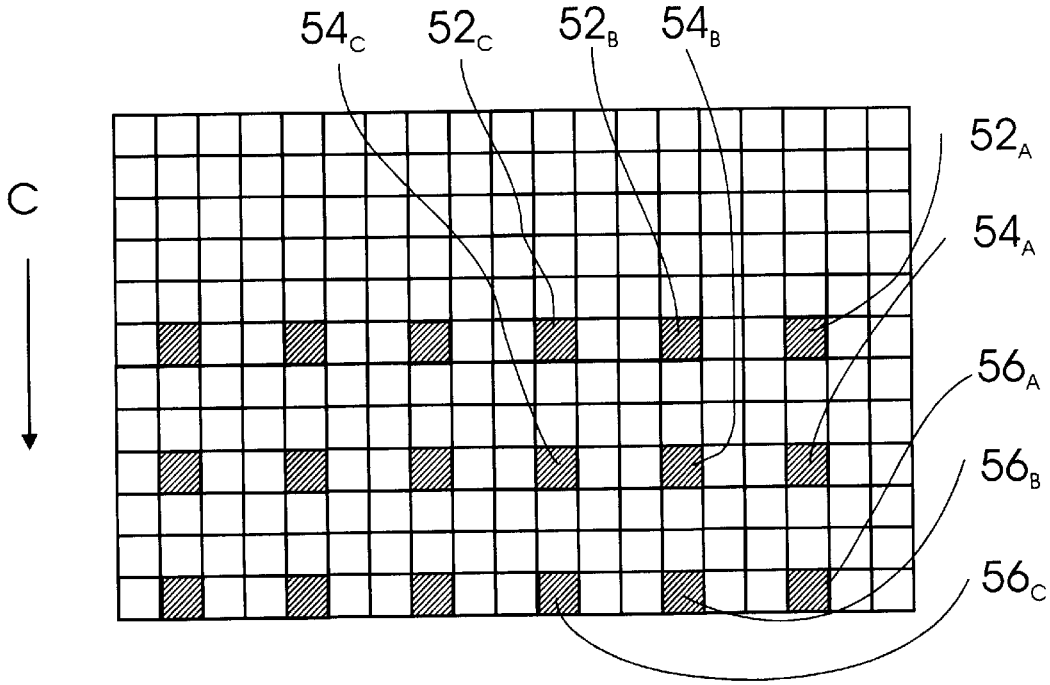
FIG. 6 is a view that illustrates the appearance of the light-indicating side of the device of FIG. 5 where the rows of the cells are switched off from the top down.
Figure 7:
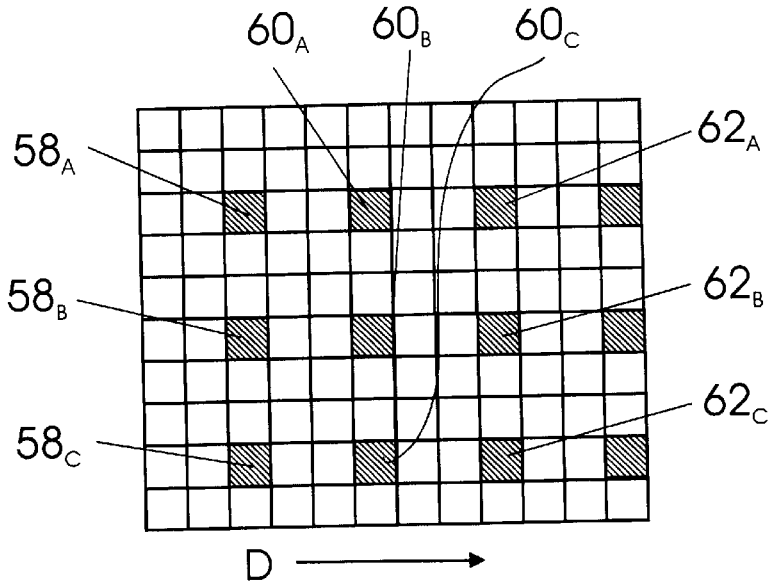
FIG. 7 is a view that illustrates an appearance of the light-indicating side of the device of FIG. 5 where the rows of the cells are switched off from the left to the right in a horizontal direction.

FIGS. 5, 6, 7—Embodiments of the Invention with Matrix Arrangement of Lamps FIGS. 5, 6, and 7 illustrate an embodiment of the invention with matrix arrangement of lamps. In this case, the lamps are conventional incandescent lamps, which are located each in an individual box-like cell closed from all sides, except for the sides facing the oncoming traffic, with light-impermeable walls. The sides that face the oncoming traffic are closed by colored transparent plates made of glass or plastic. Hereinafter, depending on the color of the transparent windows or plates, the cells will be referred to as green cells, red cells, or yellow cells.

More specifically, as shown in FIG. 5, which is a fragmental three-dimensional view of the device of the invention, the device is made in the form of a multiple-cell casing 30, divided into a plurality of cells arranged in horizontal and vertical rows. In the drawing, the upper horizontal row is formed by cells 32, 34, 36, 37, . . . The next horizontal row in the downward direction is formed by cells 38, 40, 42, 43, . . . The third horizontal row down from the top of the casing is formed by cells 44, 46, 48, 50, . . . In each row the cells are aligned, so that respective cells of horizontal rows are aligned and form vertical rows.

Each cell contains a lamp, such as incandescent lamp. Although only lamps L1, L2, L3, . . . of the extreme right vertical row are seen in FIG. 5, it is understood that at least one lamp is contained in each cell. A front and rear opening of each cell on the side of the device that faces the oncoming traffic is covered with a transparent color plate. In each row the plates of different color are arranged in a predetermined alternating order. Thus, the cells 32, 34, 36, 37, . . . of the first horizontal row are covered, from the front side, with a green transparent plate G1-1, a red transparent plate R2-1, a yellow transparent plate Y3-1, . . . , respectively. In other words, in the first horizontal row the color plates are arranged in the following sequence: green-red-yellow-green-red-yellow, etc. The cells 38, 40, 42, 43, . . . of the second horizontal row in the downward direction are covered with a yellow transparent plate Y2-1, a green transparent plate G2-1, a red transparent plate R2-1, etc. In other words, in all horizontal rows, the plates of different colors are arranged with the same sequence, but with a shift by one step with respect to the color plates of the adjacent upper row. As a result, the color plates of vertical rows alternates in a predetermined order, which, however, may be different from the sequence of colors in the horizontal rows. For example, in a vertical rows the color plates are arranged in the following order: red-green-yellow-red-green-yellow, etc.

It is understood that the color of the plates on both sides of each cell is the same, although the rear-side plates are not seen in FIG. 5.

In operation, the lamps L1, L2, L3, . . . are switched on and off under control of the same electric circuit as shown in FIG. 3. At the first moment after the traffic light has been switched to a new light signal, all the lamps of the device 30, which are located in the cells with the color of the transparent plates matched to that of the light signal, are lit. For example, if the traffic light is green, only all green cells will be lit. With the lapse of time, the lamps of the green cells will be gradually switched off step by step by rows from the top to the bottom. FIG. 6 illustrates the appearance of the light-indicating side of the device in the middle of light-indicating cycle. The rows of lamps 52*a*, 52*b*, 52*c*, . . . , 54*a*, 54*b*, 54*c*, . . . 56*a*, 56*b*, 56*c*, . . . are switched off in the direction of arrow C.

FIG. 7 illustrates an appearance of the light-indicating side of the device in the middle of light-indicating cycle of a traffic light when the electric circuit of FIG. 3 switches the rows of lamps 58*a*, 58*c*, 58*d*, . . . , 60*a*, 60*b*, 60*c*, . . . , 62*a*, 62*b*, 62*c*, . . . in the direction of arrow D.

Figure 8:
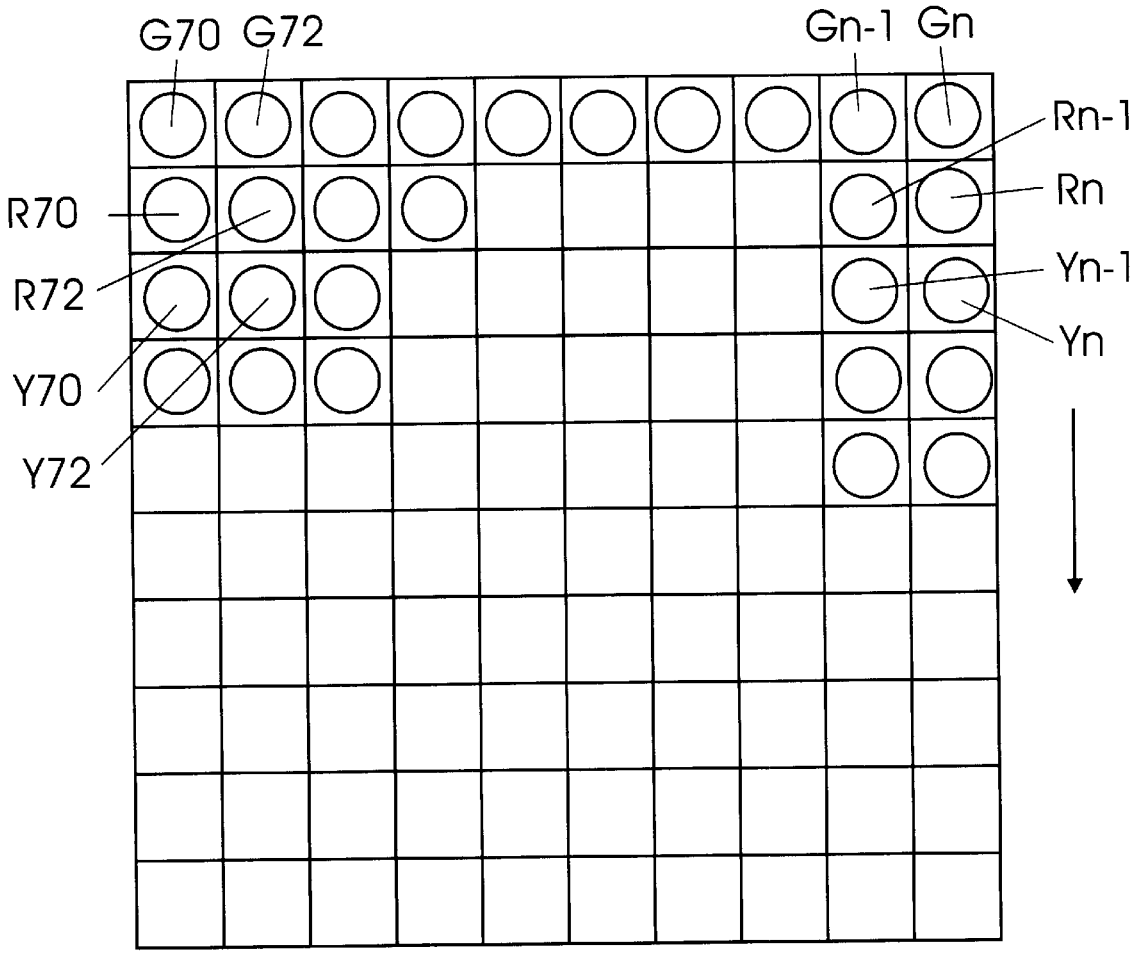
FIG. 8 is a view that illustrates an appearance of the light-indicating side of the device of the invention where each cell of the row is of the same color and the cells are switched off from the top down.
Figure 9:
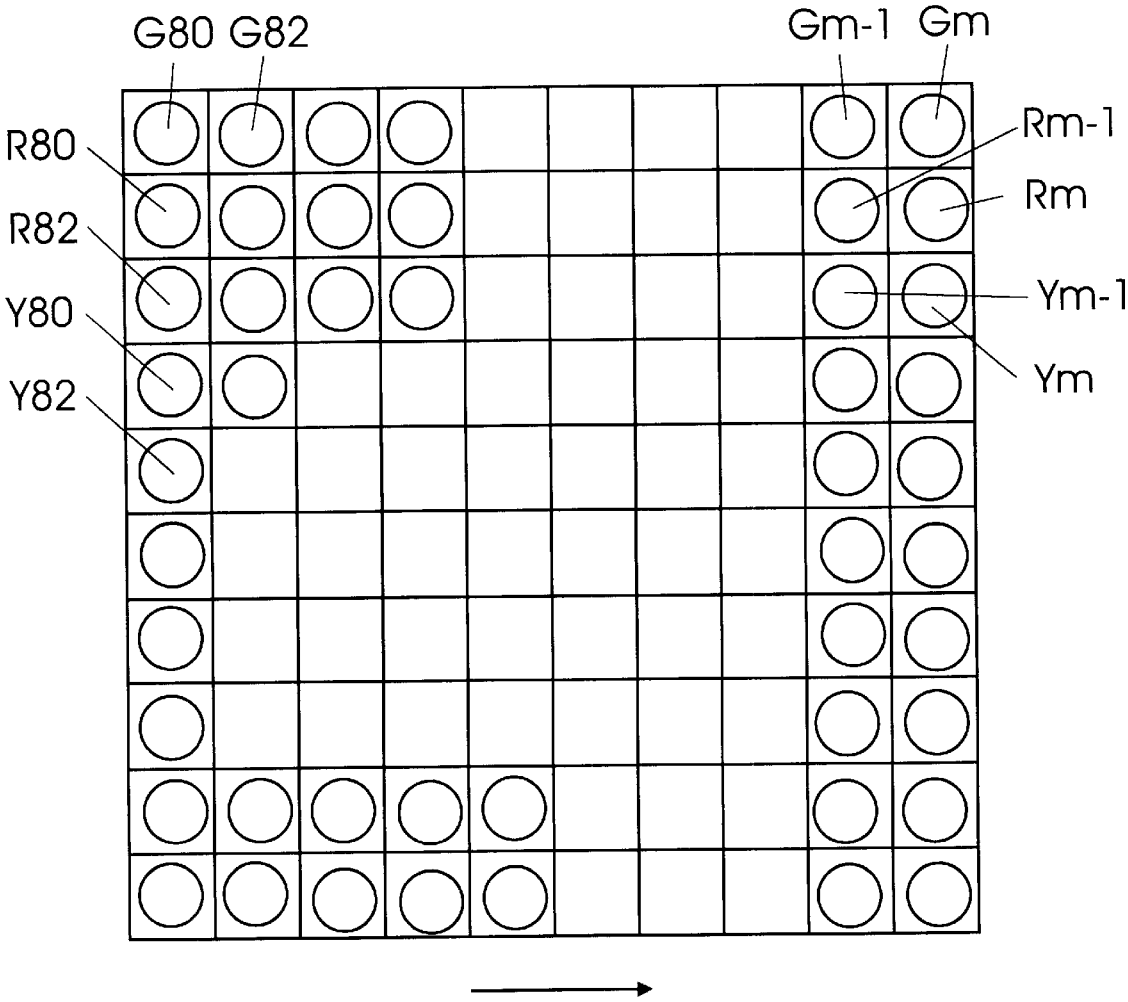
FIG. 9 is a view that illustrates an appearance of the light-indicating side of the device of the invention where each cell of the row is of the same color and the cells are switched off from the left to the right.

FIGS. 8 and 9 illustrate other embodiments of the invention, which differ from those of FIGS. 6 and 7 only by different patterns of color cells. More specifically, in the device of FIG. 8, each horizontal row has cells of the same color. For examples, the first row from the top may contain green cells, the second—red cells, the third—yellow cells, the fourth—green cells, etc. In the embodiment of FIG. 8, the electric circuit of the type shown in FIG. 3 controls the lamps so that only green cells G70, G72, . . . G(n−1), Gn are lit and are switched off in a step-like manner from top to the bottom, when a green traffic light is on. Similarly, only red cells R70, R72, . . . R(n−1), Rn are lit and are switched off in a step-like manner from top to the bottom, when a green traffic light is on, and only yellow cells Y70, Y72, . . . Y(n−1), Yn are lit and are switched off in a step-like manner from top to the bottom, when a yellow traffic light is on.

In the embodiment of FIG. 9, the cells of the same color are located in vertical rows, and the electric circuit of the type shown in FIG. 3 controls the lamps so that only green cells G80, G82, . . . G(m−1), Gm are lit and are switched off in a step-like manner from top to the bottom, when a green traffic light is on. Similarly, only red cells R80, R82, . . . R(m−1), Rm are lit and are switched off in a step-like manner from top to the bottom, when a green traffic light is on, and only yellow cells Y80, Y82, . . . Y(m−1), Ym are lit and are switched off in a step-like manner from left to the right, when a yellow traffic light is on.

Thus it has been shown that the invention provides an attachment to traffic light apparatus for visual indication of traffic light duration, which is simple in construction, is free of moving parts, ensures sequential indication of traffic light duration signs of different colors over the entire length of the indication panel an therefore can be made with large dimensions, and can be installed in any convenient location irrespective of the position of the traffic light apparatus.

Although the invention has been described and illustrated with reference to specific embodiments, it is understood that these embodiments should be construed as limiting the scope of application of the invention and that any modifications and changes are possible, provided they do not depart from the scope of patent claims. For example, the lamps can be arranged in a pattern different from those described in this patent application. Lamps of different types can be used, as well as two or more lamps can be installed in each cell. The device itself can be installed in any location convenient for observation. The rows of lamps can be switched off from right to the left, from bottom to the top, on in a diagonal direction. The cells may have a round or any other cross section. The colored cells can be arranged not only in a regular pattern, but in irregular pattern as well.

What is claimed is:

1. An attachment to a traffic light apparatus for visual indication of a current traffic light signal duration comprising:

a single display means without physically moving parts for sequentially reproducing on the same surface area colored visual images of the same color as the color of the current traffic light and with said surface area being reduced substantially in proportion with the time remaining till switching of said current traffic light signal to another traffic light signal, said single display means comprising a housing separated into a plurality of individual colored cells having light-impermeable walls from all sides, except for the sides that face the oncoming traffic, and having transparent walls on said sides that face oncoming traffic; said plurality of color cells being divided into green cells, red cells, and yellow cells; said transparent walls being formed by colored transparent plates, which define the color of respective color cells on which said color transparent plates are installed; said plurality of color cells being arranged in a matrix form with parallel horizontal and vertical rows with at least one light source in each said individual color cell.

2. The attachment of claim 1, wherein in each said vertical and horizontal row said green cells, red cells, and yellow cells are arranged in an alternating order.

3. The attachment of claim 1, wherein each said vertical and horizontal row is formed by said color cells of the same color and wherein said vertical and horizontal rows with the cells of the same color are arranged in an alternating order.

4. The attachment of claim 2, wherein each said light source is an incandescent lamp.

5. The attachment of claim 3, wherein each said light source is an incandescent lamp.

6. The attachment of claim 1, further provided with control means for controlling operation of said light sources, so that only light sources of the color cells of the same color as the color of the current traffic light are lit at the same time.

7. The attachment of claim 6, where said control means comprises a clock circuit that receives clock signals from said traffic light apparatus and a central processing unit that switches said lamps row in a row by row sequence required to ensure a decrease of said surface area in proportion with the time remaining till switching of said current traffic light signal to another traffic light signal.

* * * * *